US007210186B2

(12) United States Patent
Bigio

(10) Patent No.: US 7,210,186 B2
(45) Date of Patent: May 1, 2007

(54) HAIRBRUSH

(75) Inventor: Alberto Lee Bigio, Barranquilla (CO)

(73) Assignee: Plasticos Vandux De Columbia S.A. (CO)

( * ) Notice: Subject to any disclaimer, the term of this patent is extended or adjusted under 35 U.S.C. 154(b) by 659 days.

(21) Appl. No.: 10/691,001

(22) Filed: Oct. 22, 2003

(65) Prior Publication Data

US 2004/0078913 A1 Apr. 29, 2004

Related U.S. Application Data

(60) Division of application No. 09/954,131, filed on Sep. 17, 2001, now Pat. No. 6,739,016, which is a continuation-in-part of application No. 09/731,191, filed on Dec. 6, 2000, now abandoned, which is a continuation-in-part of application No. 09/451,747, filed on Nov. 30, 1999, now abandoned.

(51) Int. Cl.
*A46B 9/02* (2006.01)

(52) U.S. Cl. ..... 15/160; 15/186; 15/DIG. 5; 132/120; D4/128; D4/133; D4/134

(58) Field of Classification Search ..... 15/159.1, 15/160, 164, 167.1, 186, DIG. 5; 132/120; D4/104, 11, 128, 130, 132–134
See application file for complete search history.

(56) References Cited

U.S. PATENT DOCUMENTS

D118,422 S 1/1940 Weber
D126,205 S 4/1941 Gustafson et al.
D140,438 S 2/1945 Cohen
2,799,283 A 7/1957 Kapusnyk (Continued)

FOREIGN PATENT DOCUMENTS

GB 17666 0/1896

(Continued)

OTHER PUBLICATIONS

Globalink Marketing Ltd., Hong Kong, HK Enterprise, Jan. 1998, p. 451 (1 pg).

(Continued)

*Primary Examiner*—Mark Spisich
(74) *Attorney, Agent, or Firm*—Robert C. Kain, Jr.; Fleit Kain

(57) ABSTRACT

The hairbrush includes an elongated member having a handle segment and a bristle substrate segment. The bristle substrate defines an hourglass shaped core having a central region that is either cylindrically shaped or has a substantially similar elliptical cross-sections bounded on either side by dimensionally larger end regions. A plurality of hairbrush bristles are attached over the bristle substrate. The hairbrush bristles can have substantially equal lengths such that the outer peripheral portions of the plurality of hairbrush bristles defines an hourglass shape. Alternatively, the hairbrush bristles can have varying lengths such that the bristle ends form a planar surface or substantially cylindrical surface. Rectangular and oval shaped bristle substrates are also disclosed. The plurality of hairbrush bristles may be disposed over the bristle substrate individually or in groups of small bundles, and can form varying patterns such as a linear pattern, a spiral pattern or a predetermined, spaced apart pattern.

17 Claims, 13 Drawing Sheets

U.S. PATENT DOCUMENTS

| | | | | |
|---|---|---|---|---|
| 2,827,646 | A | 3/1958 | Hoffman | |
| D188,712 | S | 8/1960 | Baumgartner | |
| D191,488 | S | 10/1961 | Golden | |
| 3,691,585 | A | 9/1972 | Flom | |
| D226,253 | S | 2/1973 | Anthony et al. | D4/133 |
| 3,727,260 | A | 4/1973 | Spydevold | |
| 3,792,504 | A | 2/1974 | Smith | 15/167.1 |
| 3,949,765 | A | 4/1976 | Vallis | |
| 4,014,064 | A | 3/1977 | Okazaki | |
| D292,850 | S | 11/1987 | Glasberg | D4/128 |
| D295,464 | S | 5/1988 | Stephens | |
| D424,303 | S | 5/2000 | Tobias | |
| 6,098,635 | A | 8/2000 | Marino | 132/238 |
| 6,739,016 | B2 | 5/2004 | Bigio | |

FOREIGN PATENT DOCUMENTS

| | | |
|---|---|---|
| GB | 532285 | 1/1941 |
| GB | 630648 | 10/1949 |
| GB | 2165142 | 4/1986 |

OTHER PUBLICATIONS

Fuller Brush Catalog, Inc., 1988 (1 pg.)

Notice of Publication for brush-model—Columbian Patent Office, Serial No. 98-072813, published Jun. 28, 1999 (2pgs.).

HAIRBRUSH

This is a divisional claiming priority to application Ser. No. 09/954,131, filed Sep. 17, 2001 now U.S. Pat. No. 6,739,016, which is a continuation-in-part of patent application Ser. No. 09/731,191, filed Dec. 6, 2000 now abandoned, and a continuation-in-part of patent application Ser. No. 09/451,747, filed on Nov. 30, 1999 now abandoned.

The present invention relates to a hairbrush, its substrate, and its hairbrush bristles.

BACKGROUND OF THE INVENTION

Conventional hairbrushes include an elongated member typically including a handle segment and a bristle segment. Commonly, the bristle segment is a solid, cylindrical shape having a constant diameter throughout its axial length. In standard brushes, the bristle ends are inserted into a solid, cylindrical area having a substantially constant diameter throughout its axial length. Alternatively, the bristle ends are inserted into a substantially flat surface. During the process of brushing hair with a traditional brush, the contact area of the bristles with hair and the curved surfaces of the head is a fraction of the brush area. Typically, only the bristles in the central region of the brush come in contact with the scalp and hair roots. As such, only a fraction of the bristles perform the actual brushing of the hair.

There is a need in the marketplace for an anatomically correct hairbrush which provides a larger contact area between the bristles and the hair roots, and for a volume-creating hairbrush.

OBJECTS OF THE INVENTION

It is an object of the present invention to provide an anatomically correct hairbrush.

It is another object of the present invention to provide a hairbrush suitable to groom humans as well as to groom animals.

It is another object of the present invention to provide a flat or round hairbrush that has an hourglass shape about its bristle substrate.

It is another object of the present invention to provide flat and round hairbrushes with an hourglass shape on its bristle substrate manufactured in a variety of shapes, with or without handles, and made with a solid core or with a hollow core.

It a further object of the present invention to provide hairbrushes having an hourglass shape, such as a trapezoidal hourglass shape, a concave hourglass shape, a convex hourglass shape and an hourglass shape with an elliptical cross-section.

It is another object of the present invention to provide hairbrushes having an hourglass shape which incorporates a radially equidistant or flat central region at or near the center of the hourglass. This central area may have any desired length as long as it maintains the hourglass configuration of the bristle substrate.

It a further object of the present invention to utilize bundles of hairbrush bristles or individual hairbrush bristle filaments inserted substantially perpendicular into the brush substrate such that the hairbrush bristles and the central, longitudinal axis of the brush substrate form angles approximately 90 degrees.

It is yet another object of the present invention to provide a hairbrush having hairbrush bristles of substantially equivalent length such that the hourglass shape of the substrate is projected radially outward to the outer peripheral edges of the hairbrush bristles.

It is a further object of the present invention to provide an anatomically correct hairbrush which achieves significantly more contact area with the scalp, hair and hair roots during brushing.

It is another object of the present invention to provide an anatomically correct hairbrush that gives the user a wider brushing area than that provided for by traditional hairbrushes, and thus promotes more contact between the hair and the hairbrush bristles allowing brushing of hair with less effort, less pressure and less mistreatment of the scalp and hair, thereby promoting better stimulation of the scalp and giving the hair a healthy shiny luster.

It is another object of the present invention to provide an anatomically correct hairbrush allowing more hairbrush bristle penetration and contact with the scalp and hair roots, thereby reducing the quantity of hair sliding out from between the hairbrush bristles of the brush and enhancing the efficiency of heating and blow drying hair.

It is another object of the present invention to provide an anatomically correct hairbrush which presents less bristle substrate material in the central mid-region allowing the hair and the hair ends to wrap around the hairbrush tighter, giving the user better control and better results in hairstyling.

It is an additional object of the present invention to provide an anatomically correct hairbrush which enables the user to roll-up more hair on the brush due to the hourglass shape of the bristle substrate and hairbrush bristles.

It is another object of the present invention to provide an anatomically correct hairbrush which, when utilized, permits more penetration and more stretching of the hair from the roots, creating hair styles with more volume.

It is a further object of the present invention to provide a flat hairbrush with an hourglass shape on the upper surface of its bristle substrate and forming an hourglass shape with a semi-hemispherical central area with the hairbrush bristle ends.

It is another object of the present invention to provide a hairbrush that has an hourglass shape with a central cylindrical region about its bristle substrate, and that utilizes hairbrush bristles, bundles or individual filaments, having substantially equal lengths such that the outer peripheral edges of the bristles form either an hourglass with a radially equidistant central region, an arcuate segment of an hourglass shape with a radially equidistant central region, a concave or convex surface having a substantially cylindrical central region, or a trapezoidal surface having a flat or radially equidistant central region, and thereby provide a hairbrush which, when utilized, creates hair styles with more volume.

It is a further object of the present invention to provide a hairbrush with a concave or convex, generally rectangular, bristle substrate having a substantially flat or planar central region, or having a semi-hemispherical central region, and that utilizes hairbrush bristles having lengths such that the outer peripheral edges of the bristles form an arcuate segment of an hourglass shape or two hill-like shapes with a flat planar region or semi-hemispherical region at the intersection of the two hill-like cylinder-shapes.

It is another object of the present invention to provide a flat hairbrush that offers the same benefits of the hourglass shaped round hairbrush. The hairbrush can be manufactured with a core having one of several shapes and can be solid or hollow.

SUMMARY OF THE INVENTION

The hairbrush includes an elongated member having a handle segment and a bristle substrate segment. In one embodiment the bristle substrate defines a cylindrical core having a flat or radially equidistant central region and adjoining radially larger end regions. In another embodiment, the bristle substrate defines a central region with a substantially similar, elliptical cross-sectional shape adjoined by end regions having continuously dimensionally larger elliptical cross-sections. A plurality of hairbrush bristles is attached over the bristle substrate. The hairbrush bristles have substantially equal lengths such that in one embodiment the outer peripheral portions of the plurality of hairbrush bristles define an hourglass shape having a cylindrical central region or arcuate segment of such an hourglass shape. In another embodiment the outer peripheral portions define an hourglass shape having a central region with a substantially similar, elliptical cross-sectional shape. The hairbrush bristles are disposed substantially perpendicular relative to the bristle substrate surface and distributed throughout the bristle substrate in a predetermined pattern. Their distribution may be linear, spiral or of any desired bristling pattern. In one embodiment the hairbrush bristles are individually disposed on the bristle substrate in a series. In another embodiment, the hairbrush bristles are segmented into groups of small bundles and these bundles are disposed on the bristle substrate in a series. In both embodiments, each series of individual hairbrush bristles or bristle bundles are disposed perpendicular to the central axis of the hairbrush over the peripheral surface of the bristle substrate in a series. Their distribution may be linear, spiral or any desired predetermined bristling pattern. In one embodiment, the bristles are axially spaced apart in a common radial plane passing through the axial center line of the brush. A flat hairbrush with an hourglass shape on the upper surface of its bristle substrate is also disclosed herein.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a hairbrush. It should be understood that the hairbrush described herein is suitable for use on humans, pets and other animals with hair such as horses.

Figure 1:
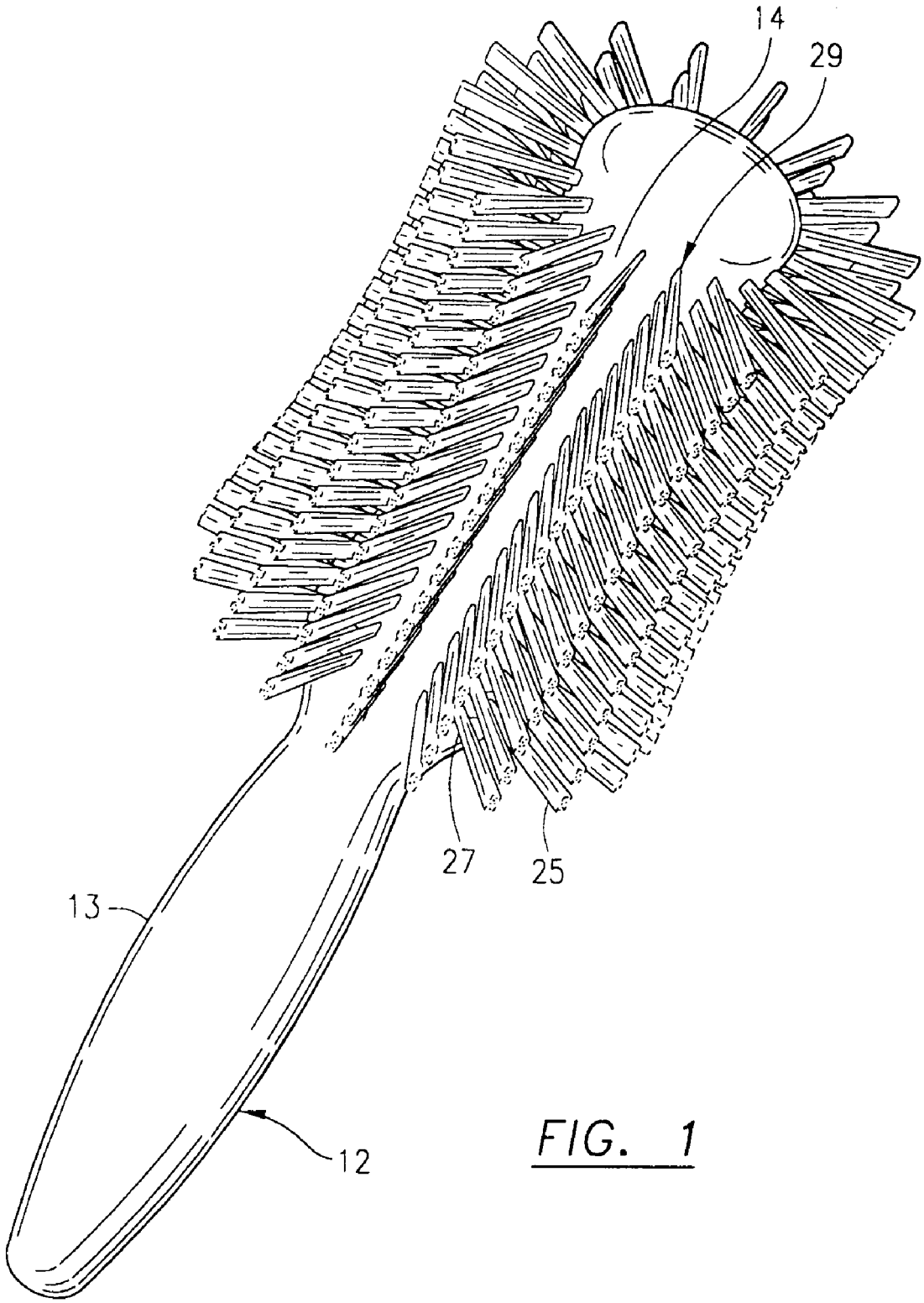
FIG. 1 diagrammatically illustrates a perspective view of the hairbrush.
Figure 3:
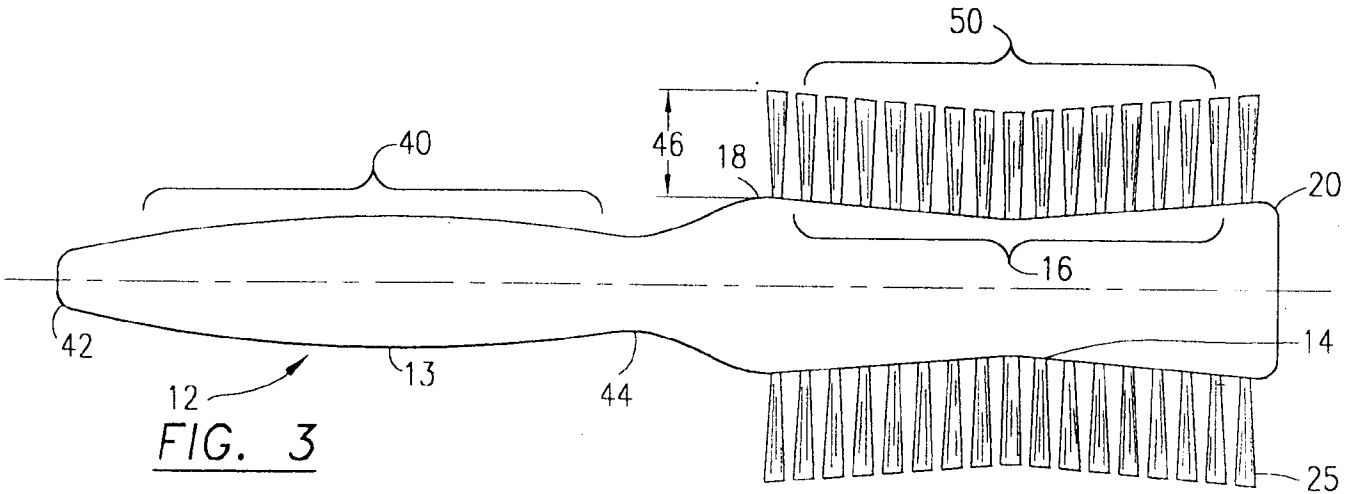
FIG. 3 diagrammatically illustrates the hairbrush and particularly the hourglass shape or smoothly curved concave central portion of the bristle segment substrate.
Figure 2:
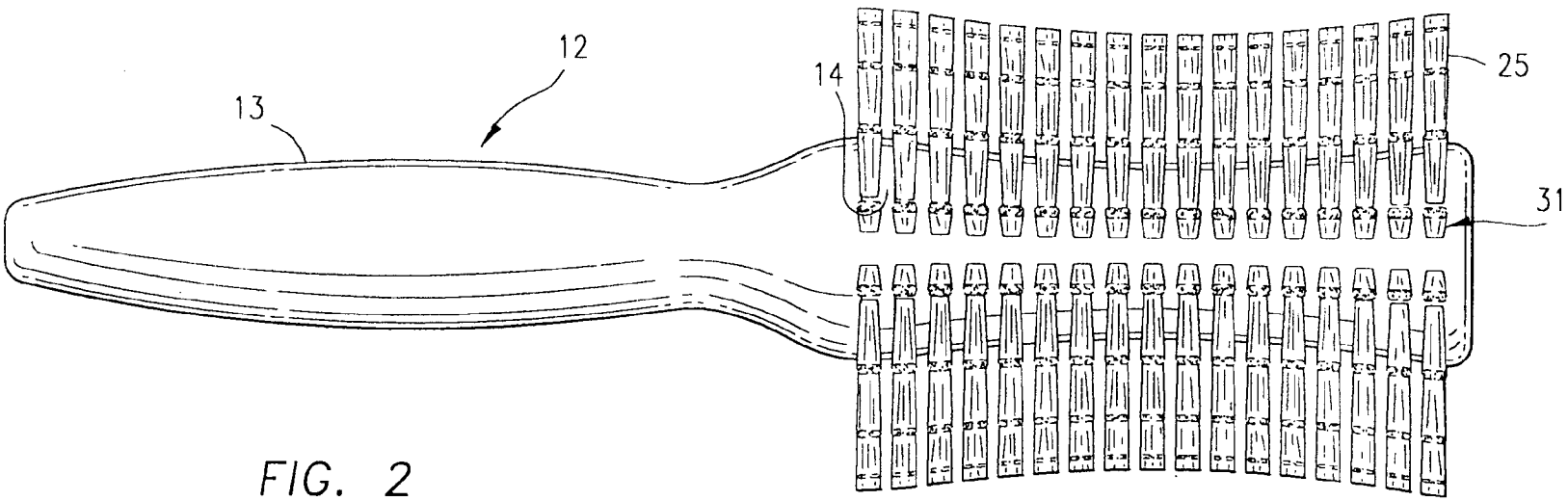
FIG. 2 diagrammatically illustrates a side view of the hairbrush.

FIG. 1 diagrammatically shows a perspective view of hairbrush 12. FIG. 2 diagrammatically illustrates a side view of the hairbrush and FIG. 3 diagrammatically illustrates a schematic of the hairbrush particularly showing the hourglass shape of bristle substrate segment 14. The figures are discussed concurrently herein. Similar reference numbers designate similar parts or areas in all the figures. Brush 12 includes handle segment 13 and bristle substrate segment 14. As best shown in FIG. 3, bristle substrate 14 has a generally cylindrical core segment with a smoothly curved concave central region 16 and radially larger end regions 18, 20. Bristle substrate 14 carries a plurality of hairbrush bristles 25 on its peripheral surface.

The plurality of hairbrush bristles 25 are grouped together in small bundles, one of which is identified as bristle bundle 27 in FIG. 1. A sub-plurality of bundles are axially aligned in a row such as row 29 shown in FIG. 1. Bristle row 29 is linear such that all bundles in the row of hairbrush bristles are disposed in a common radial plane extending through the axial centerline of the core. See bristle row 31 in FIGS. 2 and 6. Alternatively, the hairbrush bristles are individually disposed on the bristle substrate 14 (e.g. FIG. 9). Further, the bristle rows are circumferentially distributed about the peripheral surface of bristle substrate 14. This circumferential or angular offset between adjacent radial rows of hairbrush bristles reduces the force necessary to pass the brush through the subject's hair, enables faster drying of the hair with a blow dryer and requires less heat to blow-dry the hair. Further, the hourglass shape of concave central region 16 (FIG. 3) enables faster blow drying time, less heat and less effort to brush the subject's hair. The brush also gives the hair style more volume. The angular offset between radial rows also enhances massaging of the scalp during a brushing session.

Hairbrush 12 is anatomically configured such that the hourglass shape of curved concave central region 16 (FIG. 3) generally matches curves on the subject's head.

Handle segment 13 has a continuously curved convex region 40 and radially smaller end regions 42, 44.

In FIGS. 1 through 4, the hairbrush bristles have substantially equivalent lengths 46 (see FIG. 3) such that the outer periphery of a row of hairbrush bristles defines a smoothly curved concave shape about central region 50 that is complementary to the hourglass shape 16 of bristle substrate 14.

Figure 6:
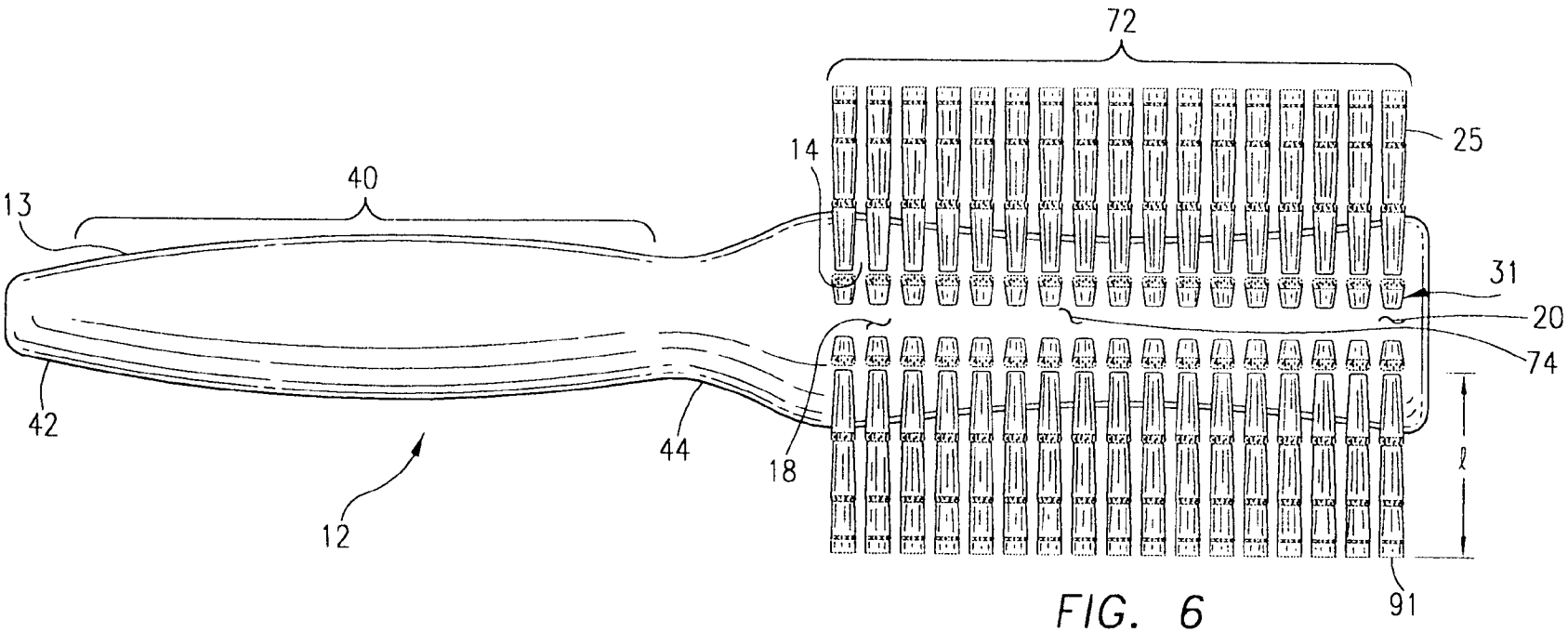
FIG. 6 diagrammatically illustrates a side view of the hairbrush with bristle ends terminating in a cylindrical shape.
Figure 8:
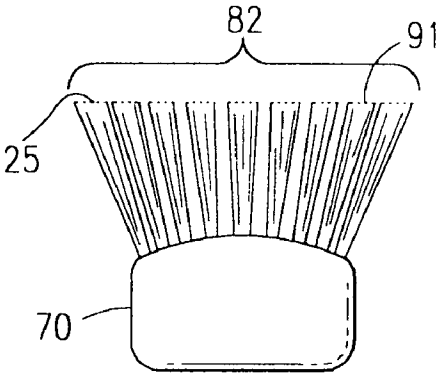
FIG. 8 diagrammatically illustrates an end view of the hairbrush.
Figure 7:
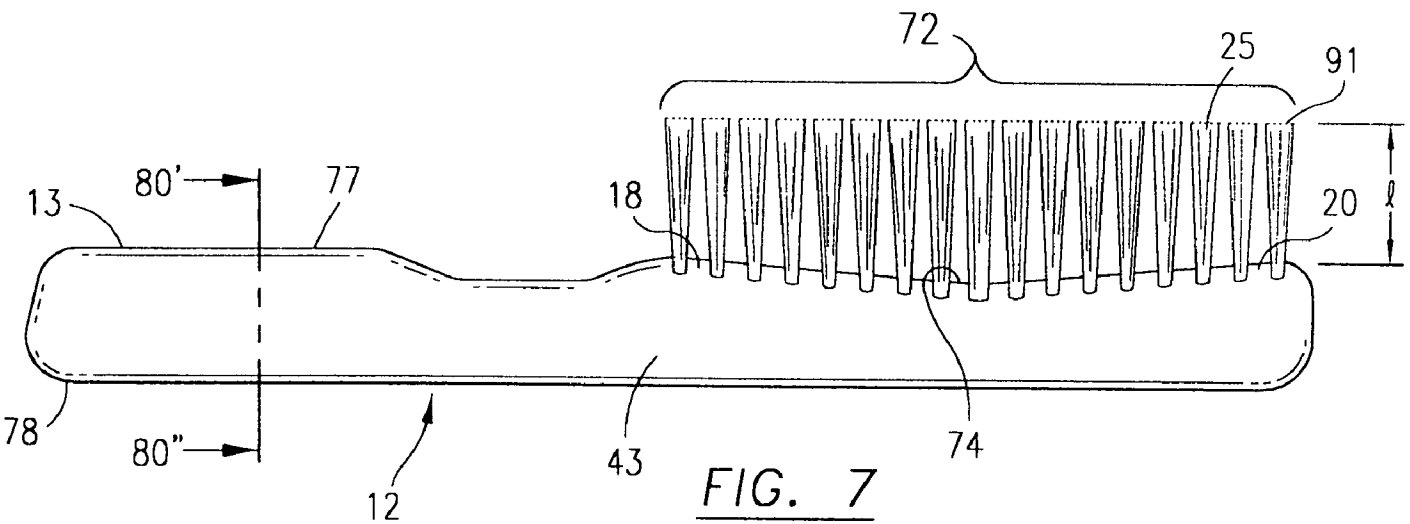
FIG. 7 diagrammatically illustrates a side view of a hairbrush with a rectangular bristle substrate with a concave central region and with bristle ends terminating in a defined shape.
Figure 18:
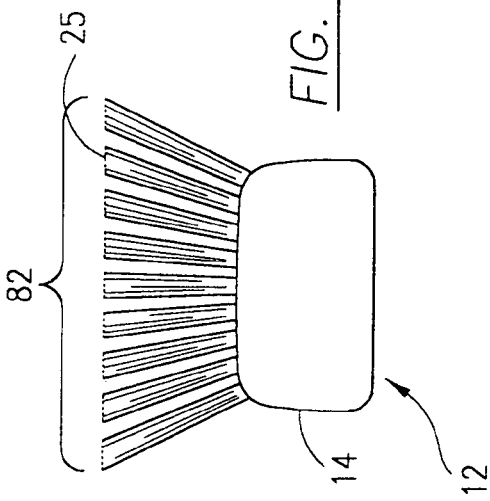
FIG. 18 diagrammatically illustrates an end view of the hairbrush in FIG. 17.

In FIGS. 6, 7, 8, 16 and 17 the hairbrush bristles have varying, predetermined lengths such that the outer periphery of a row of bristles defines a substantially straight line (see FIGS. 6 and 7, region 72, and FIG. 8, region 82). In FIGS. 6, 7, 8, 9, 16, 17 and 18 the outer periphery or the terminal ends of all the bristles define a cylinder (FIG. 6) or a predetermined arcuate segment of a cylinder (FIGS. 7 and 9) or a plane (FIGS. 8 and 18). In FIG. 6, hairbrush 12 has rows of hairbrush bristles (e.g. row 31) circumferentially disposed about bristle substrate 14 and the length 1 of the hairbrush bristle varies over the longitudinal span of substrate 14 such that the outer periphery or the terminal ends 91 of the bristles define a cylinder. Hairbrush bristles in the deeper section of concave shape 14 are longer than hairbrush bristles at the ends of bristle row 31. In FIG. 8, hairbrush 12 has rows of hairbrush bristles disposed about bristle substrate 14 such that the outer periphery or terminal ends of the bristles define a planar surface (see region 82). In FIG. 6, hairbrush bristles 25 are of predetermined varying lengths such that bristles at concave central region 74 are longer than bristles at regions 18, 20. Because the hairbrush bristles at concave central region 74 are longer, those bristles penetrate further into the subject's hair, permitting a hair dresser to create hair styles with more volume.

Figure 5:
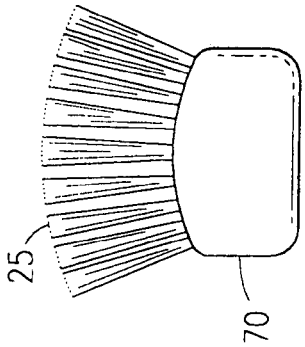
FIG. 5 illustrates an end view of the brush of FIGS. 4 and 7.
Figure 4:
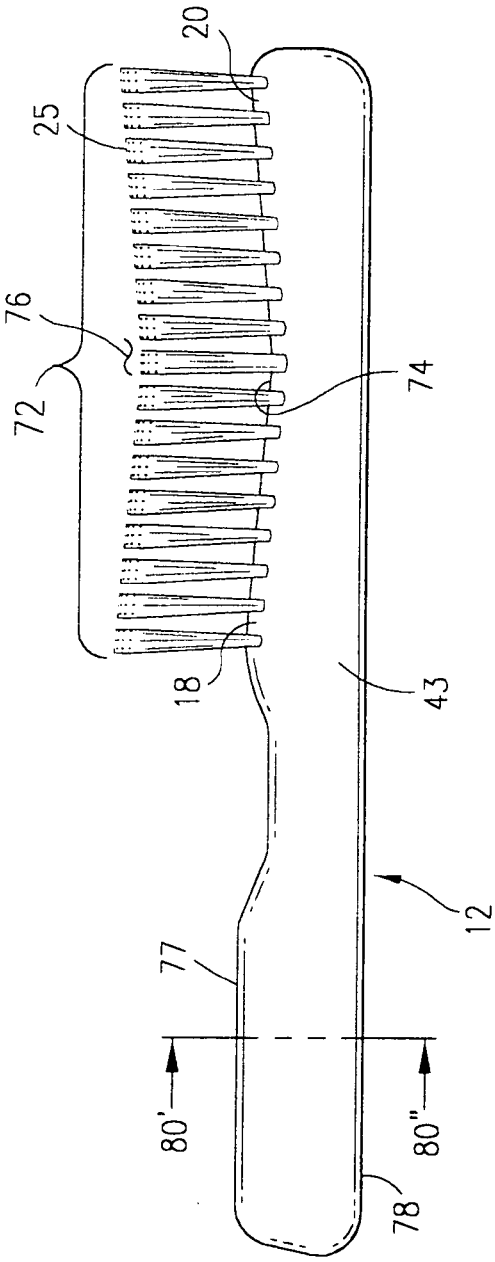
FIG. 4 diagrammatically illustrates a side view of a flat rectangular bristle substrate with a concave central region.

FIGS. 4 and 7 diagrammatically illustrate hairbrush 12 with an elongated, generally rectangular member 43. A cross-sectional aspect of member 43, from the perspective of section line 80'–80," is generally rectangular in shape. Handle 78 is shown in FIGS. 4 and 7. In FIGS. 4 and 7, handle 78 is shown with handle surface 77 substantially, longitudinally aligned with bristle substrate end regions 18 and 20. The generally rectangular cross-sectional shape of member 43 is carried forward to core segment 70 which is part of the bristle substrate segment. FIGS. 5 and 8 show the end as a rectangular shape. FIG. 5 diagrammatically illustrates an axial perspective of the outer periphery of the rows of bristles defining an arcuate segment of a cylinder. FIG. 8 diagrammatically illustrates an axial perspective of the brush wherein the outer periphery or the terminal ends of bristles in the bristle row define a planar surface 82. FIGS. 5 and 8 show the angular offset between the rows of bristles.

In FIGS. 4 and 7, brush 12 includes handle segment 78 and a bristle substrate segment extending over region 72. Hairbrush bristles 25 protrude upward from the smoothly curved concave central region 74 of the elongated, rectangular shape of bristle substrate segment 72. In FIG. 4, concave central region 74 and hairbrush bristles 25 create a concave plurality of bristle ends at region 76. In FIG. 7, hairbrush bristles 25 are of predetermined varying lengths l such that hairbrush bristles at concave central region 74 are longer than bristles at bristle substrate end regions 18, 20. Similar to the central bristles in FIG. 6, the hairbrush bristles of brush 12 in FIG. 7 at concave central region 74 penetrate further into the subject's hair, permitting a hair dresser to create hair styles with more volume. In both FIGS. 4 and 7, hairbrush bristles 25 are angularly disposed on the bristle substrate. The angular offset of hairbrush bristles 25 in linear rows is shown in FIGS. 5 and 8.

Figure 9:
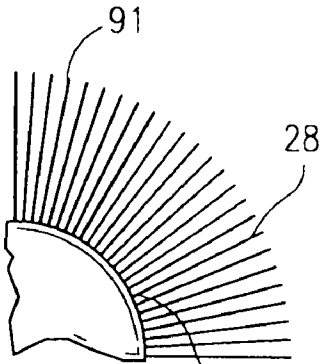
FIG. 9 diagrammatically illustrates a partial end view of the hairbrush.

In FIG. 9, each hairbrush bristle 28 is individually disposed on the bristle substrate surface 26 such that the terminal ends or outer periphery of all the bristle ends 91 define a predetermined arcuate segment of a cylinder. Individual hairbrush bristles, rather than bundles of bristles, may be utilized in connection with both the cylindrical core embodiment (FIG. 3) and the rectangular core embodiment (FIGS. 4 and 7).

Figure 10:
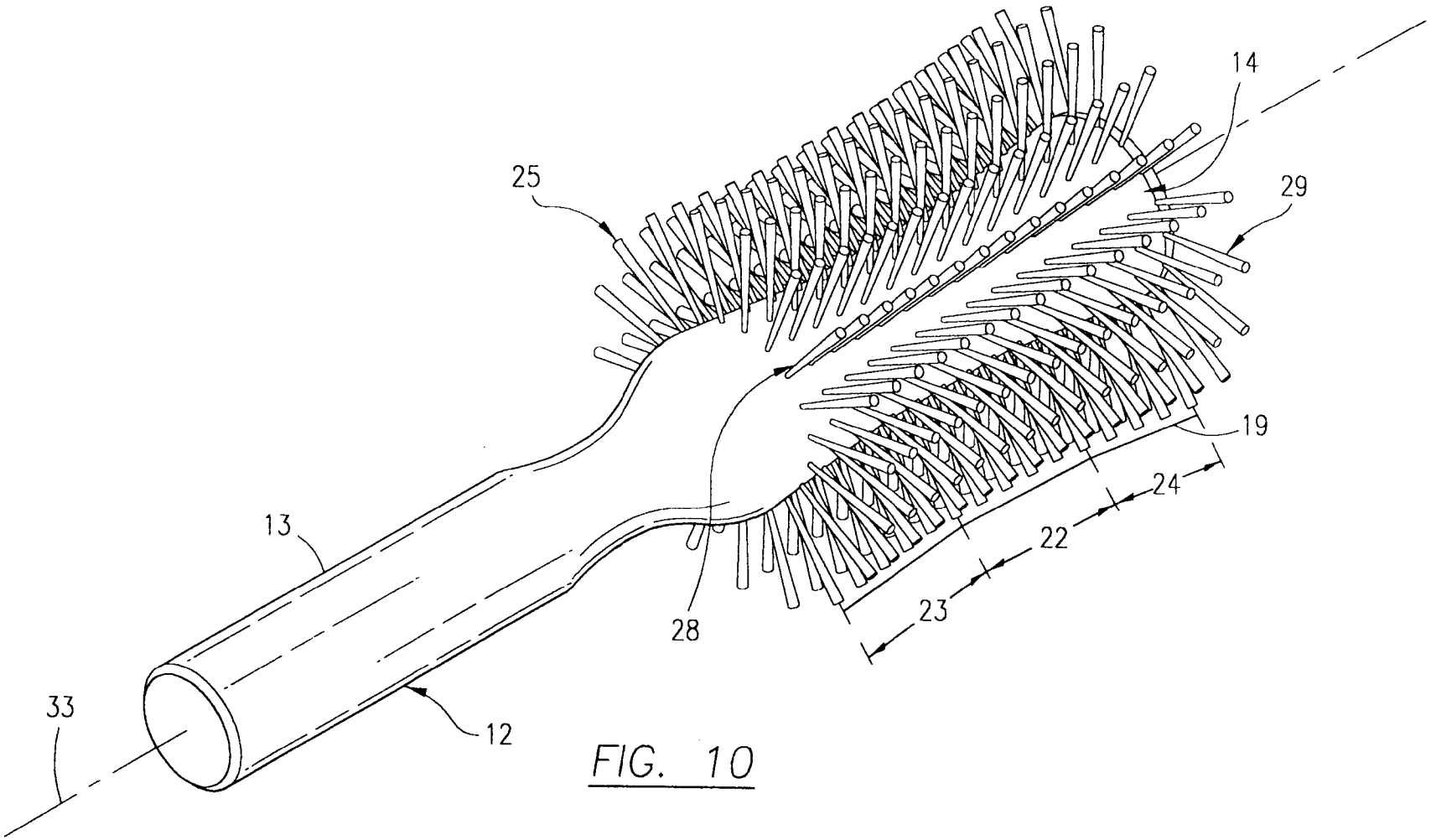
FIG. 10 diagrammatically illustrates a perspective view of the round hairbrush with the central cylindrical region.

FIG. 10 diagrammatically shows a perspective view of the cylindrical or round hourglass-shaped hairbrush 12 with a radially equidistant central region 22. The radially equidistant or cylindrical central region 22 is defined by the segment of the bristle substrate 14 between regions 23 and 24. Bristle substrate end regions 23 and 24 extend from central region 22 to opposing bristle substrate ends with continuously increasing radial dimensions. The radial dimensions of end regions 23, 24 may vary. The central region 22 is a longitudinal region of the bristle substrate which is radially equidistant from the longitudinal axis 33 (see FIGS. 12A, 12B and 12C) traversing the hairbrush. In FIGS. 11, 12A, 12B and 12C, the periphery of bristle substrate 14 in central region 22 defines a cylinder. Reference line 19 illustrates the slopes of the flat or radially equidistant central region 22 juxtaposed by the radially variable end regions 23, 24.

In another embodiment of the hourglass shape, the core 70 has an elliptical or oval cross-sectional shape (see FIG. 15C), such that the central region 22 is a longitudinal region of the bristle substrate 14 with a substantially similar, elliptical cross-sectional shape. The central region 22 is bounded at either end by end regions 23, 24 having continuously, dimensionally larger, elliptical cross-sections to opposing bristle substrate ends.

Figure 11:
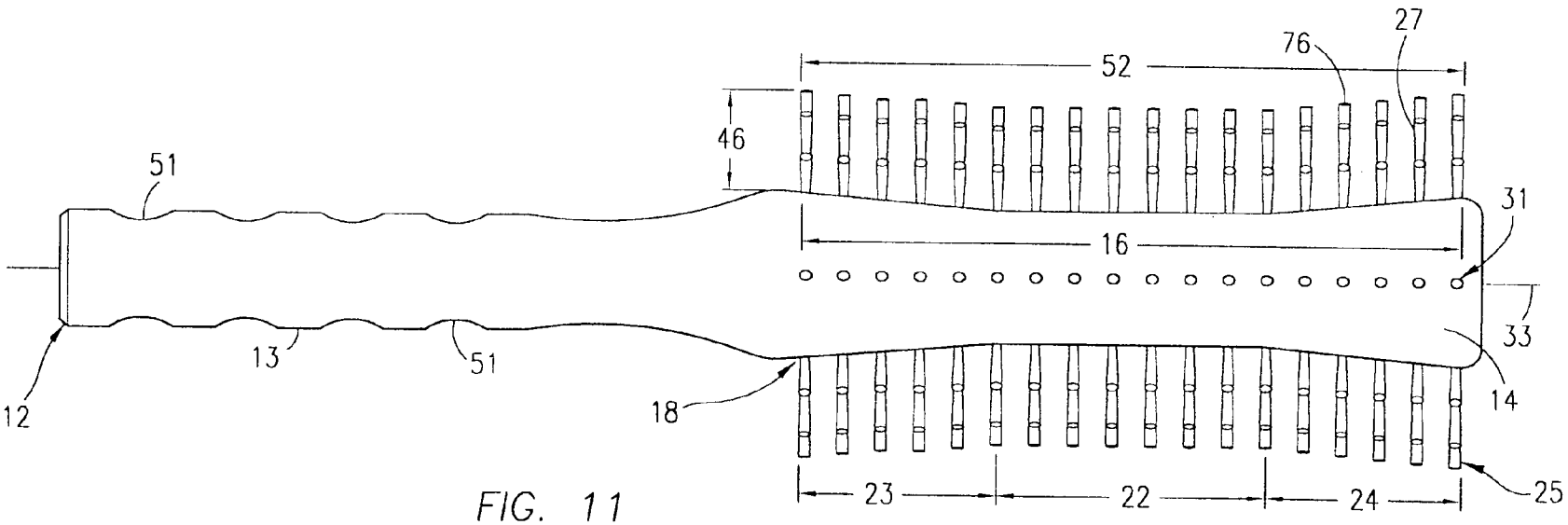
FIG. 11 diagrammatically illustrates a side view of the round hairbrush with a radially equidistant central region.

FIG. 11 diagrammatically illustrates a side view of the round, trapezoidal hourglass-shaped hairbrush 12, particularly showing the hourglass shape of bristle substrate 14. Brush 12 includes handle segment 13 and bristle substrate segment 14. A side view or cross-sectional view of hairbrush 12 reveals that region 22 is parallel to or radially equidistant from the common axial centerline 33. Both the substrate surface and the ends of the hairbrush bristles 25 within region 22 define a cylinder or radially equidistant shape, or a substantially similar elliptical cross-sectional shape. In all the hourglass shaped hairbrushes, the axial length of the central region of the hourglass (the constant radial diameter region or the constant elliptical cross-sectional shaped central region) may be one of many desired axial lengths.

Figure 12A:
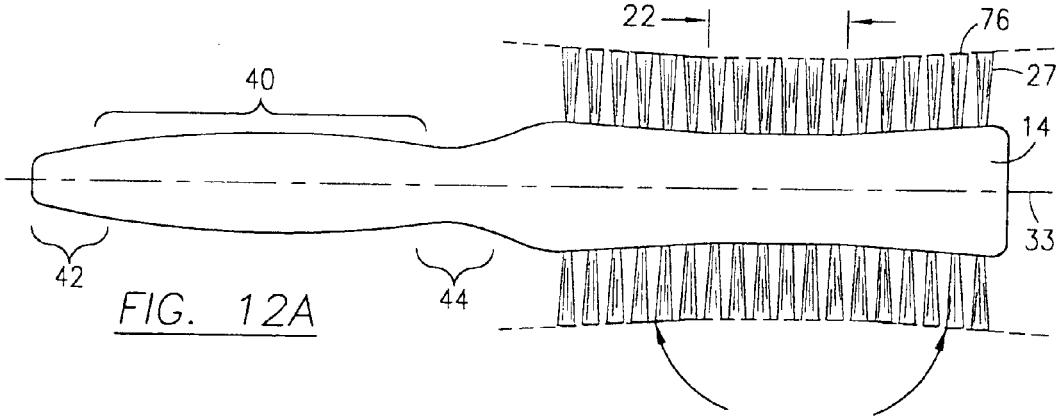
FIG. 12A diagrammatically illustrates the hairbrush with a trapezoidal hourglass shape having a flat or cylindrical central region in the bristle substrate.
Figure 12B:
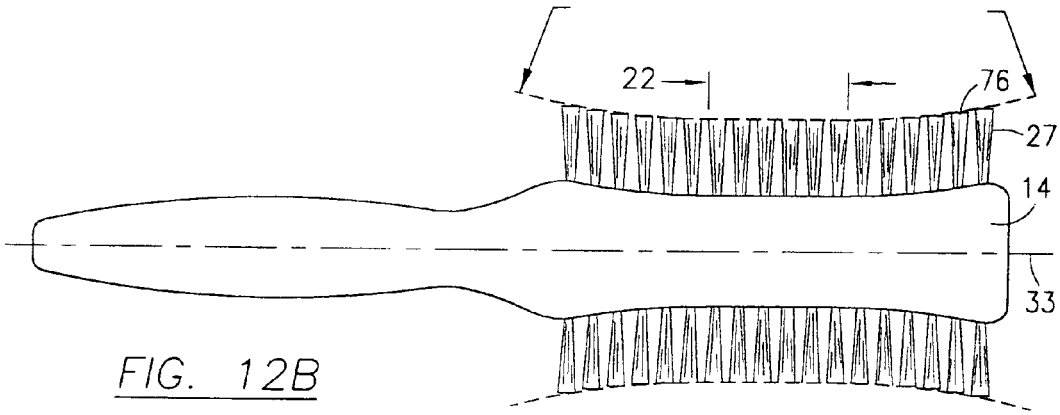
FIG. 12B diagrammatically illustrates the hairbrush with a concave hourglass shape with a cylindrical cental region in the bristle substrate.
Figure 12C:
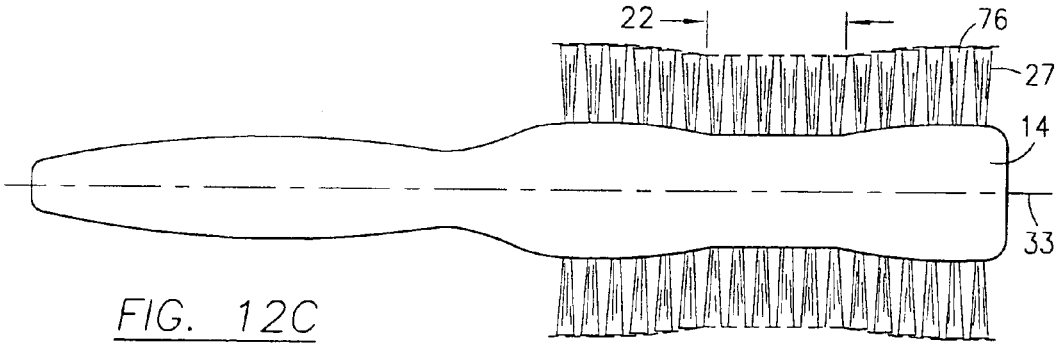
FIG. 12C diagrammatically illustrates the hairbrush with a convex hourglass shape with a cylindrical central region in the bristle substrate.
Figure 13B:
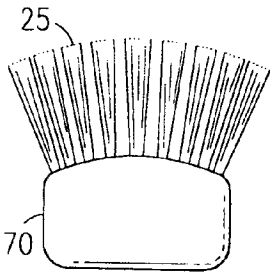
FIG. 13B illustrates an end view of the brush of FIGS. 13A and 17.
Figure 13A:
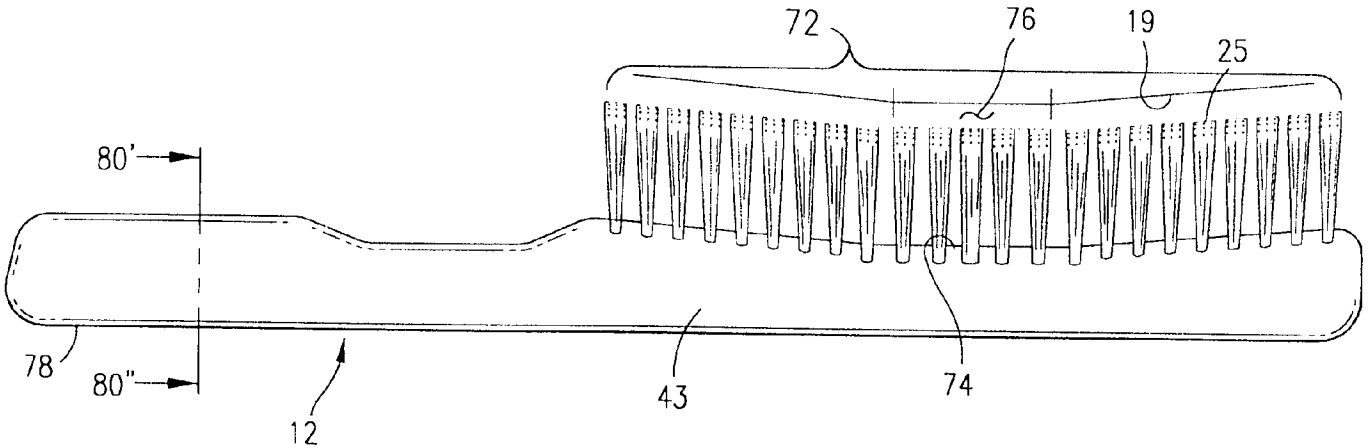
FIG. 13A diagrammatically illustrates a side view of a rectangular bristle substrate with a trapezoidal or concave bristle substrate having a flat or semi-hemispherical central region.

FIGS. 12A, 12B and 12C diagrammatically illustrate hairbrush 12 having a trapezoidal, concave, and convex hourglass shape, respectively. Each of the hairbrushes has a central region 22 having either a cylindrical shape or a substantially similar elliptical cross-sectional shape (i.e. having oval or elliptical cross-sections of substantially equal dimensions). FIGS. 11, 12A, 12B and 12C are discussed concurrently. Bristle substrate 14 has a generally cylinder-like core segment with a flat or radially equidistant central region 22 and radially larger end regions 23, 24. Bristle substrate 14 carries a plurality of hairbrush bristles 25 on its peripheral surface. The hairbrush bristles 25 can vary in thickness and be made of natural or synthetic materials or a combination thereof. The hairbrush bristles 25 can be single hairbrush bristle filaments 28 (see FIG. 10) embedded into the bristle substrate 14 or bundles of hairbrush bristles 27 (FIGS. 11, 12A, 12B and 12C). The hairbrush bristles 25 or bristle bundles 27 are perpendicularly inserted or embedded into the bristle substrate 14. Because the hairbrush bristles 25 are substantially of equal length, the trapezoidal, concave and convex shapes of the underlying substrate 14 are projected radially outward and defined by the outer peripheral edges of the bristles 76. The distribution of hairbrush bristles 25, whether in bundles 27 or individually, may be linear, spiral or of any desired bristling pattern.

In FIGS. 11, 12A, 12B and 12C, the plurality of hairbrush bristles 25 are grouped together in small bundles, one of which is identified as hairbrush bristle bundle 27. A sub-plurality of bundles are axially aligned in a row such as row 31 shown in FIG. 11. Bristle row 31 is linear such that all hairbrush bristles in the row are disposed in a common radial plane extending through the axial centerline of the core. See also bristle row 29 in FIG. 10. Alternatively, the hairbrush bristles are individually disposed on the bristle substrate 14 (FIG. 10). Further, the bristle rows are circumferentially distributed about the peripheral surface of bristle substrate 14. This circumferential or angular offset between adjacent radial rows of bristles allows more contact with the scalp and roots of the hair, promoting stimulation of the scalp and reducing the force necessary to pass the brush through the subject's hair. See angular offset in FIGS. 15A and 15B. Further, the hourglass shape, including the central region 22, enables a faster drying of the hair with a blow dryer and requires less heat and less effort to blow-dry the hair. The hairbrush design also allows for better penetration enabling a tighter hold of the hair shafts and a better stretching of the hair from the roots, and thus, creating hairstyles with more volume. The angular offset between radial rows also enhances massaging of the scalp during a brushing session.

Hairbrush 12 is anatomically configured such that the hourglass shape, including the central region 22, adapts to the shape of the subject's head. The cylindrically shaped central region 22 or the similar elliptical cross-sectional shaped central region 22 can vary in length from a few millimeters to a few centimeters.

Handle segment 13 can be cylindrical or tubular (including oval or elliptical), triangular, square, polygonal, wider at one end than the other, and can be designed in any shape allowing a person to grab and utilize the hairbrush. For example, the hairbrush handle 13 can be cylindrical with depressions 51 large enough to accommodate the width of a person's fingers (see FIGS. 11 and 16), or the handle can have a flat, rectangular body. In FIGS. 12A, 12B and 12C, handle segment 13 has a continuously curved convex region 40 and radially smaller end regions 42, 44. In addition, the entire brush core, or a portion thereof, may be solid or hollow. For example, the bristle substrate 14 may be solid with a hollow handle segment 13, or vice versa.

In FIGS. 10 through 15B drawings, the hairbrush bristles 25 have substantially equivalent lengths 46 such that the outer periphery of a row of bristles defines an hourglass shape about region 52 (see FIG. 11) that is complementary to the hourglass shape 16 of bristle substrate 14. Accordingly, because the hairbrush bristles 25 are attached to the bristle substrate perpendicular with respect to the longitudinal, central axis 33 of the hairbrush, the hourglass shape of the bristle substrate 14, with its central region 22, is projected radially outward to the outer peripheral edges 76 of the hairbrush bristles 25.

Figure 14A:
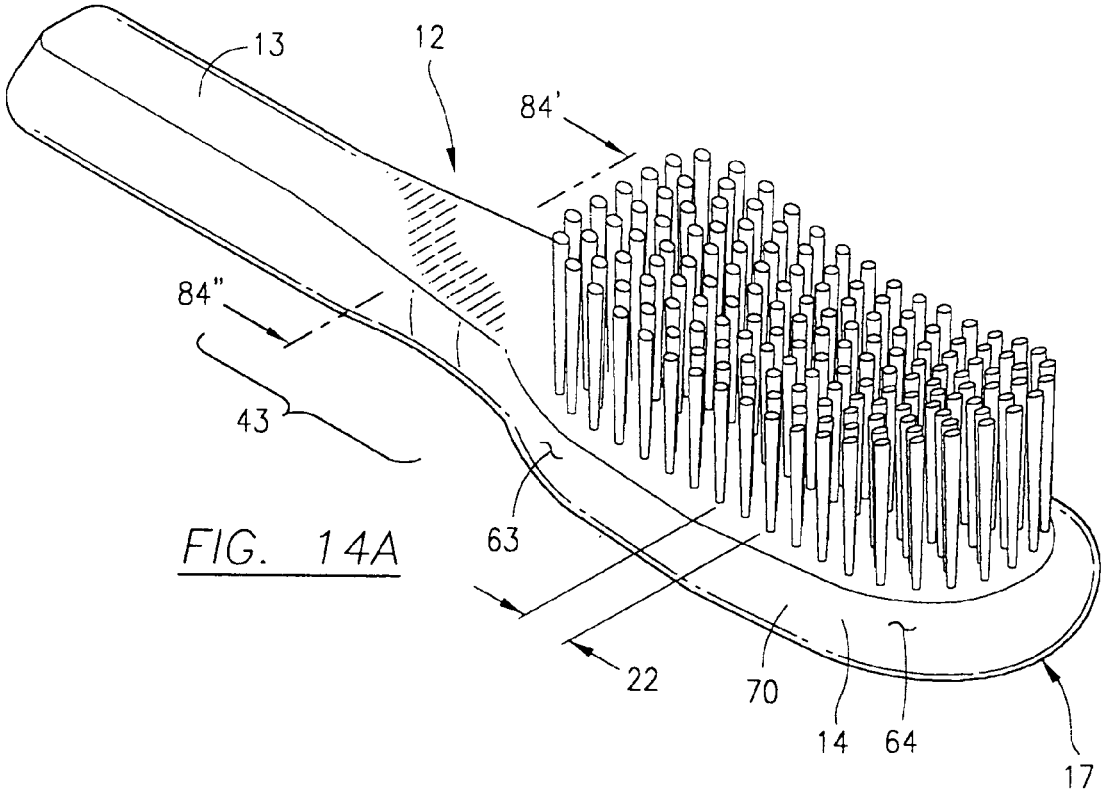
FIG. 14A diagrammatically illustrates a perspective view of a rectangular flat brush having a trapezoidal bristle substrate with a flat or semi-hemispherical central region.
Figure 14B:
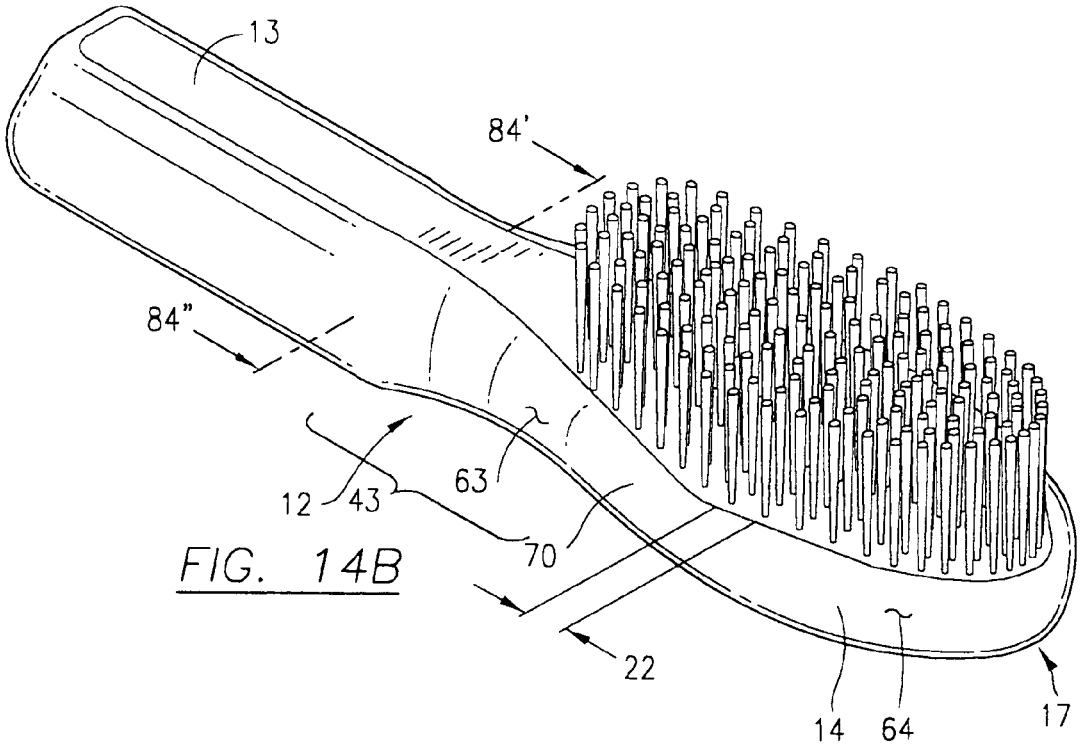
FIG. 14B diagrammatically illustrates a perspective view of an oval flat brush having a trapezoidal bristle substrate with a flat or semi-hemispherical central region.

FIGS. 14A and 14B diagrammatically illustrate a perspective view of a rectangular flat brush having a trapezoidal bristle substrate 14 with a flat or semi-hemispherical central region 22 and an oval flat or semi-hemispherical brush having a trapezoidal bristle substrate with a flat central region 22. The hairbrushes in FIGS. 14A and 14B are referred to as being flat because the hairbrush bristles are disposed on one side of a bristle substrate 14 having a substantially planar back side 17. The hairbrushes 12 in FIGS. 14A and 14B have handles 13 that include an elongated member 43. A cross-sectional aspect of member 43 from the perspective of section line 84'–84", is generally rectangular, cylindrical, trapezoidal or oval in shape. This cross-sectional shape is carried forward through core segment 70, which makes up part of the bristle substrate 14. Accordingly, the core segment 70 may have a flat central region 22 or semi-hemispherical region 22, illustrated in FIGS. 14A and 14B, as a very narrow region, surrounded or bounded by dimensionally larger or elevated regions 63 and 64. In FIGS. 14A and 14B, semi-hemispherical region 22 may define a portion or segment of a hemispherical shape defined by a center reference point below the hairbrush.

Figure 15A:
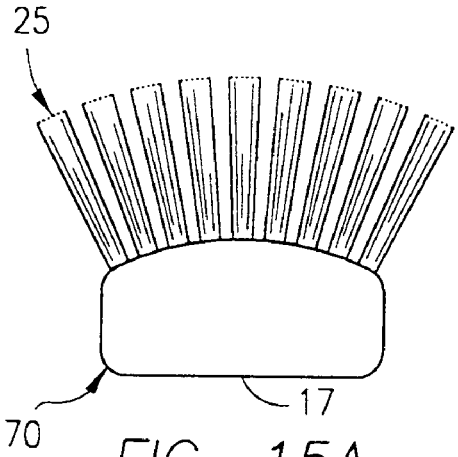
FIG. 15A diagrammatically illustrates an end view of a rectangular flat hairbrush.
Figure 15B:
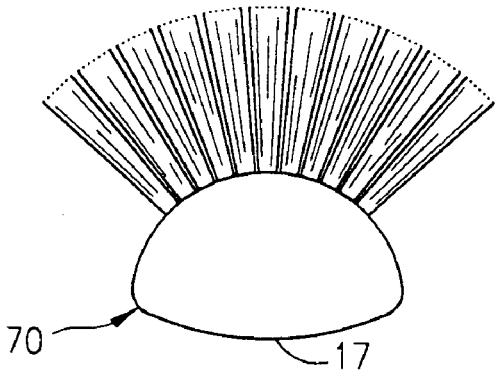
FIG. 15B diagrammatically illustrates an end view of an oval flat hairbrush.

FIGS. 15A and 15B diagrammatically illustrate an end view of the flat rectangular shaped and flat oval shaped hairbrushes, respectively. In each of the figures, the end view of the ends of the hairbrush bristles 25 define an arcuate segment of a cylinder. The end view of FIGS. 15A and 15B illustrates the angular offset of the hairbrush bristles 25 in linear rows.

Figure 15C:
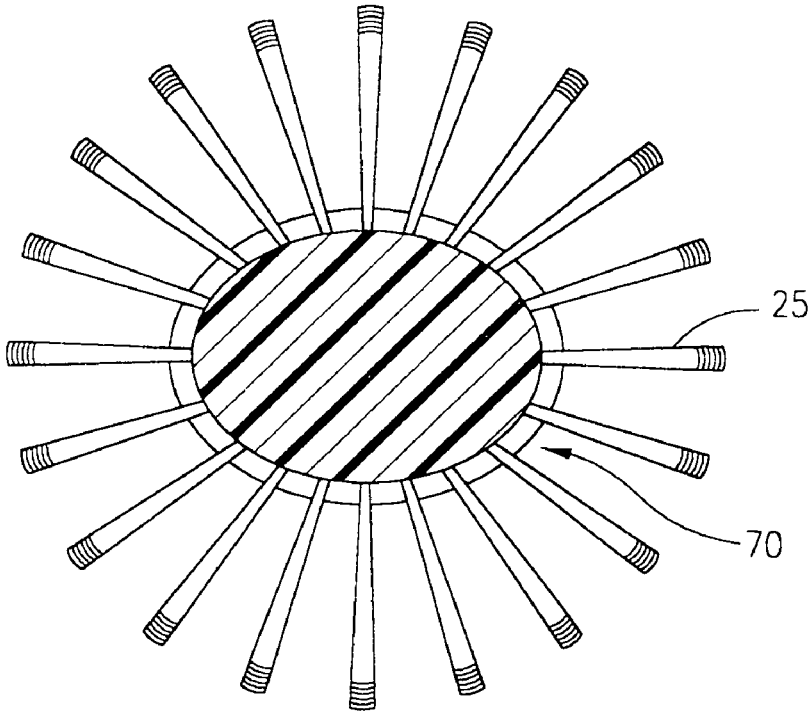
FIG. 15C diagrammatically illustrates an end view of an elliptical hairbrush.

FIG. 15C diagrammatically illustrates an end view or cross-sectional view of an oval or elliptical cross-sectional shaped hairbrush. Both the outer periphery of the core 70 and the outer periphery of the bristles 25 define an elliptical cross-sectional shape.

Figure 16:
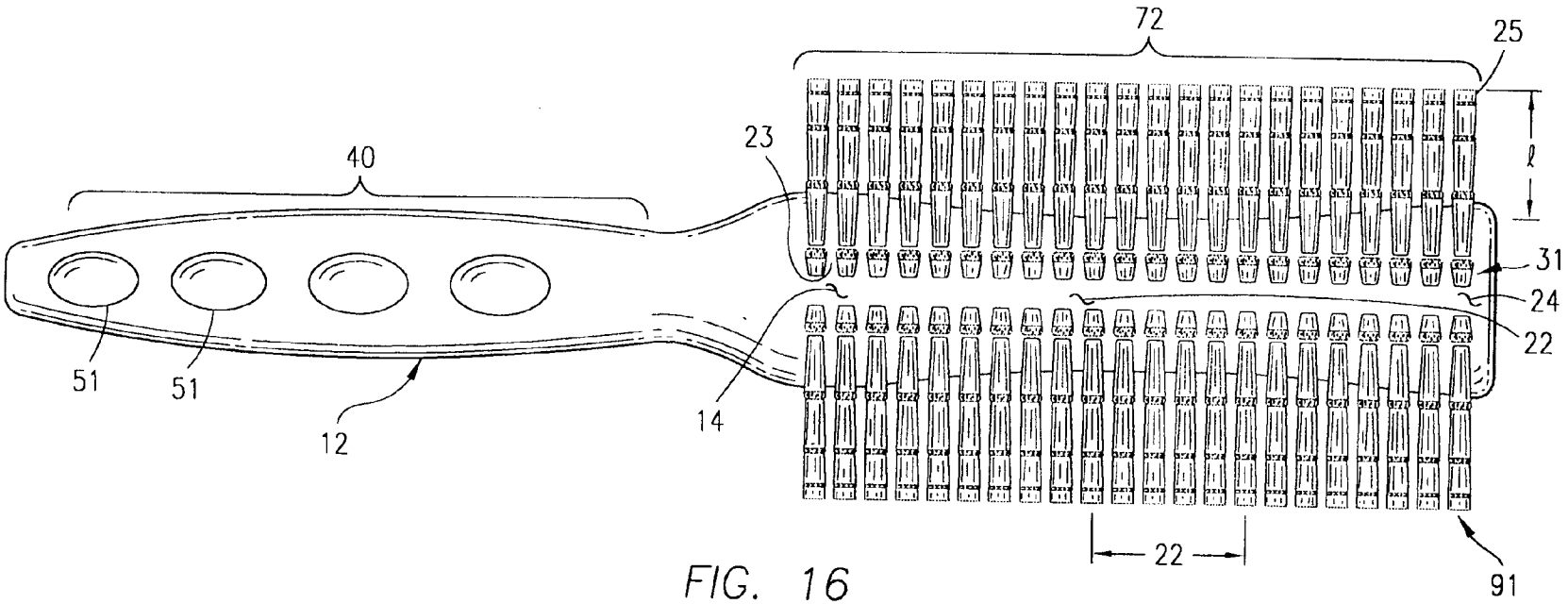
FIG. 16 diagrammatically illustrates a side view of the round hairbrush with the central cylindrical region having bristle ends terminating in a cylindrical shape.
Figure 17:
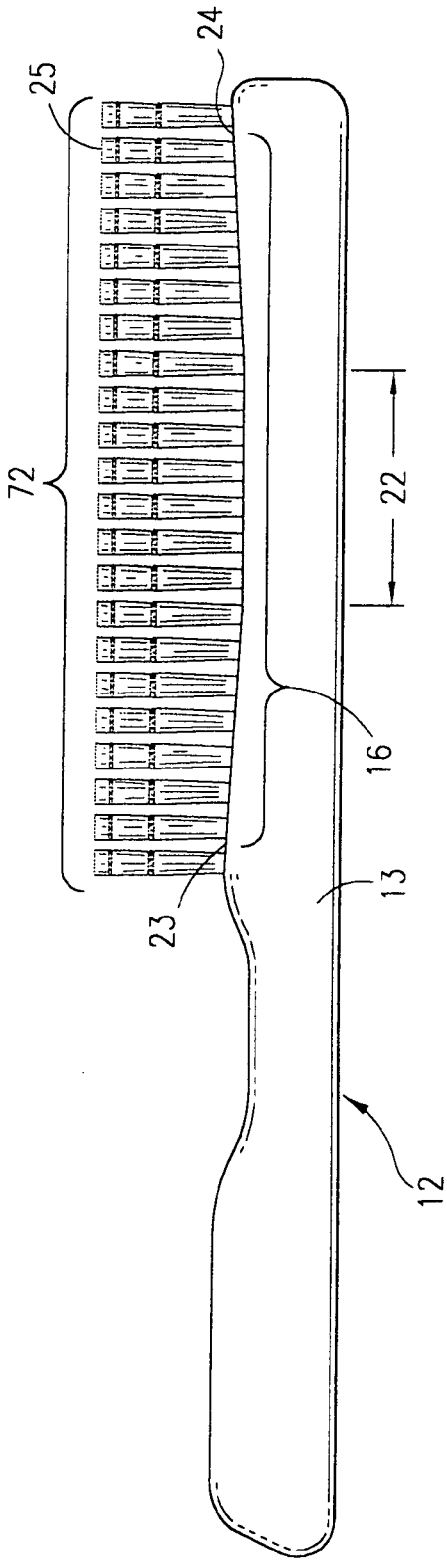
FIG. 17 diagrammatically illustrates a side view of a flat hairbrush with a rectangular bristle substrate with a flat or semi-hemispherical central region and with bristle ends terminating in a defined shape.

In FIGS. 16, 17 and 18 the hairbrush bristles 25 have varying, predetermined lengths such that the outer periphery of a row of bristles defines a substantially straight line (see also FIGS. 6 and 7, region 72, and FIG. 8, region 82 ). In FIGS. 16, 17 and 18, the hairbrushes 12 include a bristle substrate having a flat or semi-hemispherical central region 22. Similar to the hairbrushes illustrated in FIGS. 6, 7 and 8, the hairbrushes 12 in FIGS. 16 and 17 have hairbrush bristles 25 of varying lengths such that the outer periphery or the terminal ends of all the bristles define a cylinder (FIG. 16) or a predetermined arcuate segment of a cylinder (FIG. 17) or a plane (FIG. 18). In FIG. 16, hairbrush 12 has rows of bristles (e.g. row 31) circumferentially disposed about bristle substrate 14 and the length 1 of the hairbrush bristle varies over the longitudinal span of substrate 14 such that the outer periphery or the terminal ends 91 of the bristles define a cylinder. Hairbrush bristles in the central, deeper section 22 of the hourglass shape are longer than hairbrush bristles at the ends 23, 24 of bristle row 31.

In FIG. 18, hairbrush 12 has rows of bristles disposed about bristle substrate 14 such that the outer periphery or terminal ends of the bristles define a planar surface (see region 82).

The brush may be made of wood, plastic, aluminum or other material. Any combination of those elements can be utilized in the brush. The brush can be manufactured with different combinations of materials, lengths, diameters and in different colors. The handle segment can be manufactured in any desired shape and does not necessarily have to match the shape of the bristle substrate 14. For example, the handle segment 40 can have a circular cross-sectional shape, an elliptical cross-sectional shape, a triangular cross-sectional shape, a square cross-sectional shape, a trapezoidal cross-sectional shape or a polygonal cross-sectional shape.

Figure 19B:
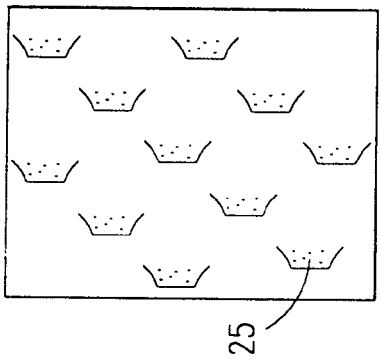
FIGS. 19A and 19B show plan views of a spiral hairbrush bristle configuration and a predetermined, spaced apart bristle configuration.
Figure 19A:
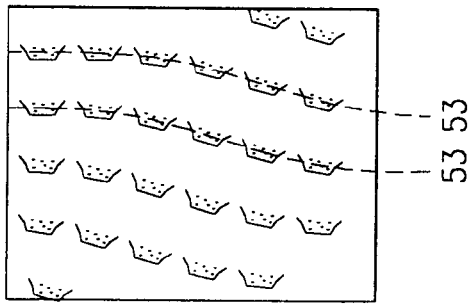

The pattern of the hairbrush bristles 25 may be linear rows (see FIGS. 1, 6 and 9), or may be spiral as in row 53 in FIG. 19A (a plan view or laid-out view of a portion of the bristle substrate) or any predetermined pattern. See FIG. 19B, a plan view of a spaced apart bristle pattern.

The claims appended hereto are meant to cover modifications and changes within the scope and spirit of the present invention.

What is claimed is:

1. A hairbrush, comprising:

an elongated member element having a handle segment and a bristle substrate segment on a common axial centerline;

said bristle substrate having a core segment with a central region with a constant elliptical cross-sectional shape and size said central region bounded by end regions having continuously dimensionally larger elliptical cross-sections to opposing bristle substrate ends defining an hourglass shaped bristle substrate;

a plurality of hairbrush bristles of substantially equal lengths attached over said bristle substrate;

said hairbrush bristles having bristle ends following said hourglass shaped bristle substrate and forming an hourglass shaped bristle brush.

2. A hairbrush as claimed in claim 1 wherein said plurality of hairbrush bristles are segregated into groups of small bundles and are disposed over a peripheral surface of said bristle substrate in a series of axially aligned and radially distributed linear bristle rows, each row consisting of a sub-plurality of hairbrush bristle bundles, each hairbrush bristle bundle in a respective linear row spaced axially apart along said bristle substrate.

3. A hairbrush as claimed in claim 2 wherein said handle segment has one of a cross-sectional shape from the group of a circular shape, an elliptical shape, triangular shape, a square shape, a polygonal shape, and a trapezoidal shape.

4. A hairbrush as claimed in claim 3 wherein said handle segment includes finger-width depressions.

5. A brush as claimed in claim 3 wherein said handle segment defines a continuously curved convex region having radially smaller handle end regions.

6. A hairbrush as claimed in claim 1 wherein said plurality of hairbrush bristles are individually disposed over a peripheral surface of said bristle substrate in a series of axially aligned and radially distributed linear bristle rows, each said linear row spaced axially apart along said bristle substrate.

7. A hairbrush as claimed in claim 1 wherein said end regions having continuously dimensionally larger elliptical cross-sections of said bristle substrate define smooth concave regions.

8. A hairbrush as claimed in claim 1 wherein said end regions having continuously dimensionally larger elliptical cross-sections of said bristle substrate define smooth convex regions.

9. A hairbrush as claimed in claim 1 wherein said plurality of hairbrush bristles are segregated into groups of small bundles and are disposed over a peripheral surface of said bristle substrate such that said small bundles form one of a pattern from the group consisting of a linear hairbrush bristle pattern, a spiral hairbrush bristle pattern and a predetermined hairbrush bristle pattern.

10. A hairbrush as claimed in claim 1 wherein said plurality of hairbrush bristles are individually disposed over a peripheral surface of said bristle substrate such that said hairbrush bristles form one of a pattern from the group consisting of a linear hairbrush bristle pattern, a spiral hairbrush bristle pattern and a predetermined hairbrush bristle pattern.

11. A hairbrush, comprising:

an elongated member element having a handle segment and a bristle substrate segment on a common axial centerline;

said bristle substrate having an hourglass shaped core segment with a central region having a constant elliptical cross-sectional shape and size leading to continuously increasing dimensionally larger elliptical end regions defining opposing bristle substrate ends;

a plurality of hairbrush bristles of various predetermined lengths attached over said bristle substrate and having bristle ends, said bristle ends of said plurality of hairbrush bristles defining one of a substantially similar elliptical cross-sectional shape and an arcuate segment of a cylindrical shape above said hourglass shaped bristle substrate.

12. A brush as claimed in claim 11 wherein said plurality of hairbrush bristles are segregated into groups of small bundles and are disposed over a peripheral surface of said bristle substrate in a series of axially aligned and radially distributed linear bristle rows, each row consisting of a sub-plurality of bristle bundles, each bristle bundle in a respective linear row spaced axially apart along said bristle substrate.

13. A brush as claimed in claim 12 wherein said handle segment has one of a cross-sectional shape from the group of a circular shape, an elliptical shape, triangular shape, a square shape, a polygonal shape, and a trapezoidal shape.

14. A brush as claimed in claim 11 wherein said handle segment defines a continuously curved convex region having radially smaller handle end regions.

15. A brush as claimed in claim 11 wherein said plurality of bristles are individually disposed over a peripheral surface of said bristle substrate in a series of axially aligned and radially distributed linear bristle rows, each said linear row spaced axially apart along said bristle substrate.

16. A hairbrush as claimed in claim 11 wherein said plurality of hairbrush bristles are segregated into groups of small bundles forming one of a pattern from the group consisting of a linear hairbrush bristle pattern, a spiral hairbrush bristle pattern and a predetermined hairbrush bristle pattern.

17. A hairbrush as claimed in claim 11 wherein said plurality of hairbrush bristles are individually disposed to form one of a pattern from the group consisting of a linear hairbrush bristle pattern, a spiral hairbrush bristle pattern and a predetermined hairbrush bristle pattern.

* * * * *